US005368190A

United States Patent [19]

Hieb et al.

[11] Patent Number: 5,368,190

[45] Date of Patent: Nov. 29, 1994

[54] APPARATUS FOR VENDING WORK OBJECTS

[76] Inventors: Larry E. Hieb, 501 W. Sierra, Apt. 227, Fresno, Calif. 93704; Toshiyuki Takamura, 8153 N. Cedar Ave., Apt. 101, Fresno, Calif. 93704

[21] Appl. No.: 129,594

[22] Filed: Sep. 30, 1993

Related U.S. Application Data

[63] Continuation of Ser. No. 860,671, Mar. 30, 1992, abandoned.

[51] Int. Cl.[5] ..... B65G 59/00

[52] U.S. Cl. ..... 221/131; 221/151; 221/197; 221/281; 221/286; 221/298

[58] Field of Search ..... 221/6–8, 221/14, 129, 130, 131, 151, 195, 197, 281, 283, 286, 287, 298, 15; 193/324

[56] References Cited

U.S. PATENT DOCUMENTS

| | | | |
|---|---|---|---|
| 2,956,661 | 10/1960 | Radcliffe | 221/6 |
| 3,090,521 | 5/1963 | Fazekas | 221/129 |
| 3,662,898 | 5/1972 | Baxendale . | |
| 3,722,744 | 3/1973 | Payne . | |
| 3,810,560 | 5/1974 | Stegeman . | |
| 3,831,806 | 8/1974 | Lindsay . | |
| 3,904,076 | 9/1975 | Payne . | |
| 4,019,650 | 4/1977 | Oden . | |
| 4,209,111 | 6/1980 | Lotspeich et al. . | |
| 4,298,138 | 11/1981 | Oden . | |
| 4,299,333 | 11/1981 | Welsch . | |
| 4,347,952 | 9/1982 | Bookout . | |
| 4,423,828 | 1/1984 | Tanaka et al. . | |
| 4,485,937 | 12/1984 | Adams . | |
| 4,498,569 | 2/1985 | Tanaka et al. . | |
| 4,509,658 | 4/1985 | Oden . | |
| 4,542,834 | 9/1985 | Kurosawa et al. . | |
| 4,565,300 | 1/1986 | Kokubun et al. . | |
| 4,574,980 | 3/1986 | Kurosawa et al. . | |
| 4,586,633 | 5/1986 | Holland et al. . | |
| 4,673,105 | 6/1987 | Kurosawa et al. . | |
| 4,676,398 | 6/1987 | Kokubun et al. . | |
| 4,679,684 | 7/1987 | Glaser . | |
| 4,682,709 | 7/1987 | Brandes et al. . | |
| 4,712,712 | 12/1987 | Garden . | |
| 4,722,455 | 2/1988 | Groover . | |
| 4,763,963 | 8/1988 | Laufer et al. . | |
| 4,779,760 | 10/1988 | Wittern et al. | 221/283 |
| 4,823,982 | 4/1989 | Aten et al. . | |
| 4,823,983 | 4/1989 | Groover et al. . | |
| 4,834,263 | 5/1989 | Beeze . | |
| 4,854,477 | 8/1989 | Kurosawa et al. . | |
| 4,913,313 | 4/1990 | Rockola . | |
| 4,917,264 | 4/1990 | Gasiel et al. | 221/298 |
| 5,176,288 | 1/1993 | Craven | 221/131 |

OTHER PUBLICATIONS

Workplace Vendor, "Pepsi At Work".

Workplace Vendor Parts And Service Manual, May 1990.

*Primary Examiner*—H. Grant Skaggs

*Attorney, Agent, or Firm*—Worrel & Worrel

[57] ABSTRACT

An apparatus for vending work objects having a main frame; a vend mechanism; a subframe, composed of a plurality of modules defining at least one work object storage area, mounted on the main frame; a mount releasably mounting the vend mechanism in vending relation to work objects received in the work object storage area; and a control system for operating the vend mechanism selectively to vend the work objects from the work object storage area.

12 Claims, 9 Drawing Sheets

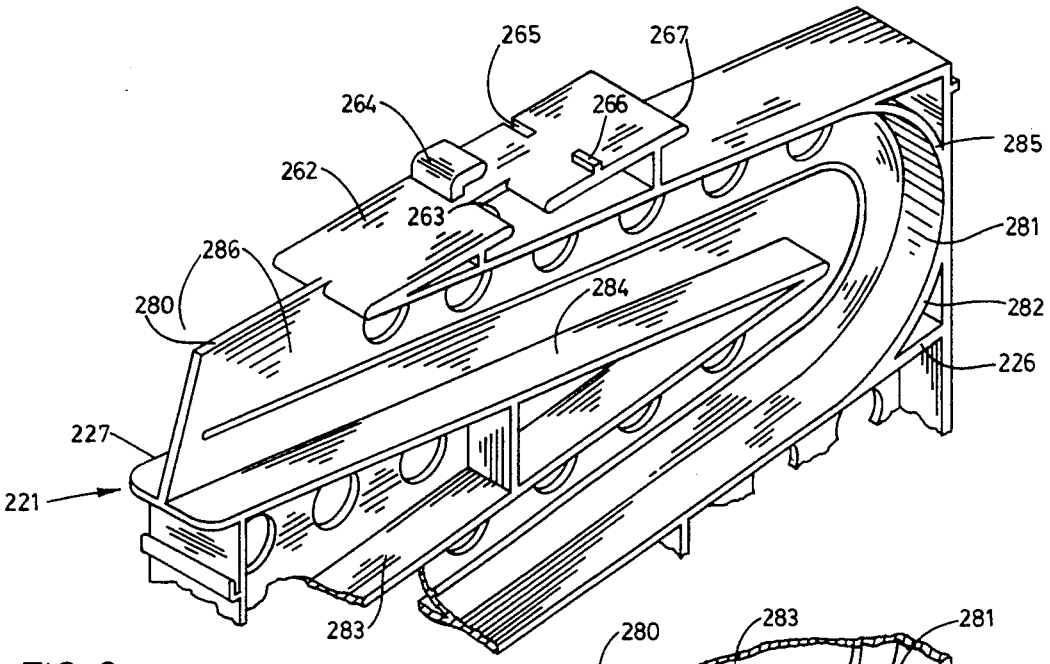
FIG. 6
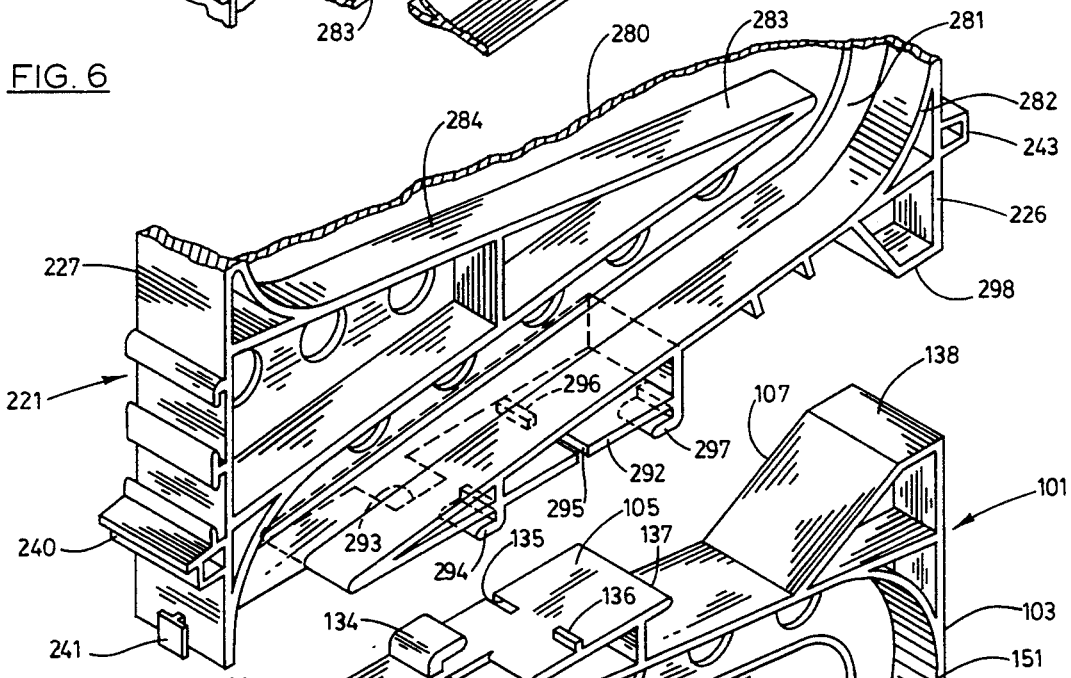
FIG. 5
FIG. 4

APPARATUS FOR VENDING WORK OBJECTS

This is a continuation of copending application Ser. No. 07/860,671 filed on Mar. 30, 1992 and now abandoned.

BACKGROUND OF THE INVENTION

1. Field of the Invention

The present invention relates to an apparatus for vending work objects and, more particularly, to such an apparatus wherein its internal storage area can be so configured as to allocate the space available to virtually any combination of work objects for vending more closely to approximate an allocation of storage space to correspond to the volume of sales for each than has heretofore been possible, which achieves this objective without a concomitant increase in either the size or the cost of the apparatus over prior art vending devices and which otherwise possesses a facility for assembly, service and repair not heretofore achieved in the art.

2. Description of the Prior Art

The design, manufacture, operation and servicing of vending machines presents a myriad of considerations which are unique to the industry. A primary consideration is the fact that any commercially successful vending machine must offer a plurality of selections from a fixed storage area. Conversely, it is inherently the case that where multiple selections are available, the quantities of each selection vended during any given period are disproportionate to each other, although in generally predictable percentages. In order most efficiently to use the available storage space within vending machines, it is known to apportion storage space within the storage area in general accordance with the known percentages of sales volume for the given commodities involved. This is known within the industry as assigning "space to sales."

While such design considerations constituted an improvement over the art, problems associated with the disproportionate sale of commodities persist. For example, the percentages of the disproportionate sales are only generally predictable. In addition, the percentages of disproportionate sales may vary substantially from environment to environment. Thus, the percentages for given commodities incident to usage at a health club, gym or the like, may vary substantially from those incident to usage at an airline terminal, train station or the like. Still further, over time these percentages of usage may change substantially. New products may be introduced which may affect the sales percentages. The relative success of advertizing campaigns may influence these percentages. Health concerns, pricing and even political considerations may have a bearing.

Heretofore, as a practical matter, the apportionment of storage space assigned to particular commodities within a vending machine was largely permanently established at the time of manufacture. The structures of the stacks within the storage area of the vending machine defining the apportioned storage areas were, as a practical matter, permanent structures. While in some instances consideration was given to adjustability so as to have the capability of varying the apportionment of storage space, the conversion of any given vending machine was simply too time consuming to be practical. Accordingly, more commonly such vending machines were simply operated with less than desirable efficiency, or replaced by new machines having the apportionment desired.

In the prior art there was only a limited ability to acid to or vary the apportionment of internal storage space of the vending machines. The only way known in the prior art to acid to existing storage space for a given commodity, or to add a different commodity for vending was to add another column devoted thereto. This could only be achieved by, in effect, reducing the numbers of columns devoted to another commodity, or by increasing the size of the vending machine to add the space for the additional column. In this regard, the percentages of apportionment of space were limited to the assignment of columns within the vending machine among the commodities to be vended therefrom. Furthermore, each column required its individual vend mechanism. While a variety of attempts were made to use fewer vend mechanisms, such prior art efforts have largely been unsuccessful. In any case, the apportionment of storage space in prior art vending machines to correspond to sales inherently increased the cost of manufacturing such vending machines because of the increase in the numbers of columns and the vend mechanisms assigned thereto.

The prior art manufacture, operation, service and repair of vending machines is chronically subject to still other deficiencies. Because of the numbers of individual stacks defining discrete commodity storage areas within such vending machines, it has heretofore been necessary to employ individual vend mechanisms for each discrete storage area. This fact increases the frequency with which failure of the vend mechanisms within any given machine will occur; increases the labor required to service and/or repair a given vending machine; and increases the cost of manufacture of such vending machines. Similarly, the construction of prior art vend mechanisms themselves has, of necessity, been complex. In order to provide the desired strength and dependability of operation, prior art vend mechanisms are assembled using screws, bolts, weldments and the like requiring substantial manual labor to assemble at the factory and are similarly labor intensive for service and repair. It is thus frequently the case that a vend mechanism requiring service or repair may simply be removed and replaced with a new vend mechanism so as to avoid the cost incident to manual service or repair thereof.

Still further, the service and/or repair of prior art vending machines in the field is complicated by the fact that the discrete columns of vendable commodities are gravitionally storing numbers of the commodities. When it is necessary to remove a vend mechanism frown a given column of a prior art vending machine, consideration must be given to the commodities stored gravitationally thereabove. Removal of the vend mechanism releases the commodities which without provision therefore will gravitationally be discharged from the vending machine. Since such release would require reloading of the column after repair of the vend mechanism and, as importantly, would damage the commodities, it is the practice within the industry to attempt to lodge any available item within the column beneath the commodities to retain them against such gravitational release. This practice is not only inconvenient and less than reliable, but also may cause damage to the vending machine.

Therefore, it has long been known that it would be desirable to have an apparatus for vending work objects which is capable of achieving a significantly more precise apportionment of storage space to sales than has heretofore been achieved in the art; which is capable of rapid and yet precise assembly for such apportionment of the storage area therewithin; which can, if desired, rapidly and precisely be modified in the field to apportion the storage area to the capacities desired for the commodities to be vended; which reduces to a hitherto unachieved minimum the number of vend mechanisms required for a given vending machine; and which can be manufactured, operated, serviced and repaired with a facility and dependability not heretofore achieved in the art.

SUMMARY OF THE INVENTION

Therefore, it is an object of the present invention to provide an improved apparatus for vending work objects.

Another object is to provide such an apparatus which can readily be assembled to apportion the storage area of a vending machine to capacities individual to the commodities to be vended which significantly more precisely correspond to the rates of sales of those commodities from the vending machine.

Another object is to provide such an apparatus wherein the internal storage capacities assigned to the individual commodities to be vended are depleted in a manner such that replenishment of the commodities can more efficiently be performed in that they reach the level requiring such replenishment at more nearly the same time.

Another object is to provide such an apparatus wherein the internal storage area thereof can be so constructed at the time of manufacture to provide such a variety of percentages of apportionment of space therein as to afford a virtually universal applicability to an infinite variety of different combinations of different commodities to be vended whereby those whose responsibility it is to select the different commodities to be vended through the vending machine, knowing the rates of sales of those commodities, can select from among the preapportioned storage areas within the vending machine storage capacities appropriate for the sales of the various commodities selected.

Another object is to provide such an apparatus which can readily be modified in the field by simply reprogramming an electronic control system to reapportion the storage area of a vending machine to capacities different from those of the vending machine at the time of manufacture.

Another object is to provide such an apparatus which permits the number of individual vend mechanisms heretofore required in prior art vending machines to be substantially reduced so as to minimize the cost of manufacture, improve durability and reduce the frequency of service and repair required by vending machines.

Another object is to provide such an apparatus which employs a vend mechanism which itself is considerably more rapidly assembled at the time of manufacture than has heretofore been possible and which retains this capability thereafter to ensure rapid and dependable service and repair.

Another object is to provide such an apparatus which otherwise facilitates the service and repair of vending machines in the field reducing to a minimum the time required to perform these services while concomitantly improving the dependability of operation thereof.

Another object is to provide such an apparatus which is more dependable in operation than prior art vending machines while being less expensive to manufacture.

Further objects and advantages are to provide improved elements and arrangements thereof in an apparatus for the purpose described which is dependable, economical, durable and fully effective in accomplishing its intended purpose.

These and other objects and advantages of the present invention are achieved, in the preferred embodiment, in an apparatus for vending work objects having a main frame; a vend mechanism; a subframe, composed of a plurality of modules defining at least one work object storage area, mounted on the main frame: a mount releasibly mounting the vend mechanism in vending relation to work objects received in the work object storage area; and an electronic control system for operating the vend mechanism selectively to vend the work objects from the work object storage area.

BRIEF DESCRIPTION OF THE DRAWINGS

FIG. 4 is a somewhat enlarged, fragmentary perspective view taken from a position indicated by line 4—4 in FIG. 2.

FIG. 5 is a somewhat enlarged, fragmentary perspective view taken from a position indicated by line 5—5 in FIG. 2.

FIG. 6 is a somewhat enlarged, fragmentary perspective view taken from a position indicated by line 6—6 in FIG. 2.

DESCRIPTION OF THE PREFERRED EMBODIMENT

Figure 1:
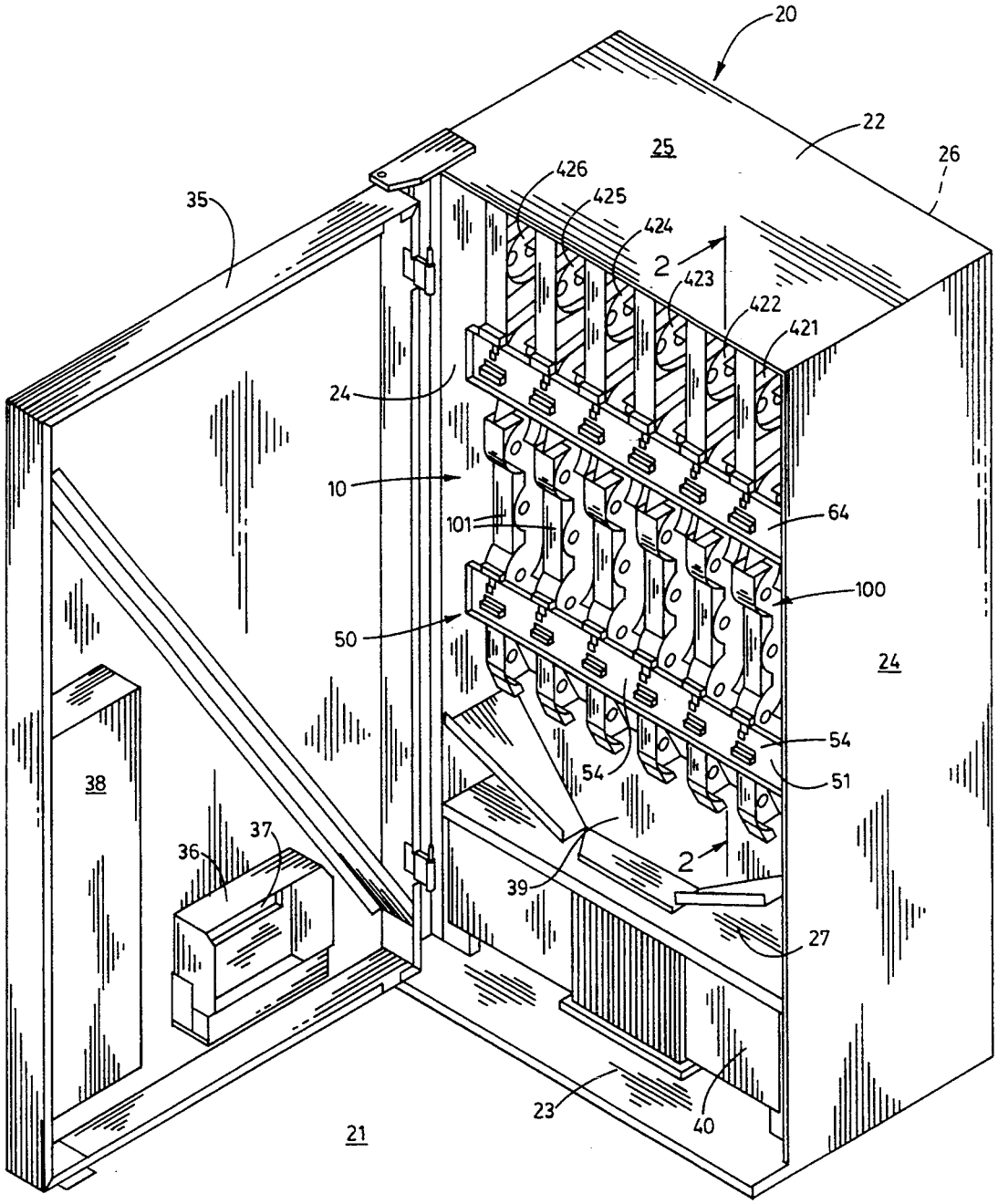
FIG. 1 is a perspective view of a conventional vending machine mounting the apparatus for vending work objects of he present invention with the door assembly thereof shown in an opened position to expose the apparatus of the present invention.

Referring more particularly to the drawings, the apparatus for vending work objects of the present invention is generally indicated by the numeral 10 in FIG. 1. It will be apparent that the apparatus of the present invention can be employed to vend a wide variety of types of work objects. For purposes of illustrative convenience, it will be understood that the work objects to be vended shown herein are substantially cylindrical, sealed beverage containers and have substantially identical dimensions. The work objects are generally indicated by the numeral 11 throughout the drawings. However, as will hereinafter become more clearly apparent, containers of different configurations as well as other types of work objects can also be vended by the apparatus of the present invention.

The apparatus 10 of the present invention is shown, for illustrative convenience, as an operable part of an otherwise conventional vending machine 20 typical of those presently used in the industry. The vending machine is shown in FIG. 1 rested in upright relation on a suitable supporting surface 21 such as a concrete floor. The vending machine has a box like housing 22 including a bottom wall 23, opposite side walls 24, a top wall 25 and a back wall 26. The walls of the housing define an interior compartment 27.

The vending machine mounts an exterior door assembly 35 for movement between a closed position sealing the housing 22 so that the interior compartment 27 thereof is fully insulated from outside conditions and the opened position shown in FIG. 1. The door assembly mounts a vending bin 36 accessed from externally of the door assembly through an opening 37. The door assembly mounts a coin box 38 of conventional design. Mounted within the interior compartment 27 is a trough 39 operable to feed vended work objects from thereabove into the vending bin 36. A refrigeration unit 40 is mounted on the bottom wall 23 within the interior compartment 27. The interior door conventionally employed in vending machines just inwardly of the exterior door assembly 35 has not been shown or described herein for illustrative convenience since it forms no part of the apparatus of the present invention.

The apparatus 10 of the present invention is hereinafter described. The apparatus has a pair of supports or brackets 48 individually mounted by screws, not shown, on the opposite side walls 24 within the interior compartment 27 of the housing 22 of the vending machine 20. The brackets have horizontal surfaces 49 defining a common plane parallel to and in predetermined spaced relation from the top wall 25 of the housing. A main frame 50 is mounted on and extended between the opposite side walls 24 within the interior compartment 27. The main frame includes a lower frame 51 composed of a pair of end frame members 52. Each of the end frame members of the lower frame is supported for slidable movement on the horizontal surfaces 49 of the brackets 48. Thus, each end frame member is disposed in upstanding relation rested on its bracket for slidable movement along a horizontal path parallel to the side wall to and from the interior compartment 27 of the vending machine. Each of the end frame members has oppositely extending mounting tabs 53. The mounting tabs nearest the exterior door assembly 35 of the end frame members 52 are secured on the opposite side walls 24 by any suitable fasteners such as screws, not shown. The mounting tabs farthest from the exterior door assembly are not secured on the opposite side walls.

The lower frame 51 includes a pair of side frame members 54 mounted on and extending between the end frame members 52 in spaced, substantially parallel relation. Thus, the end frame members and side frame members define a rectangular space bounded thereby. It will be seen that by removal of the screws extending through the mounting tabs nearest the exterior door assembly, the lower frame can be pulled from the interior compartment 27 sliding along the brackets 48. Each of the side frame members has an tapper flange 55 extending outwardly therefrom substantially right angularly related to the side frame member. Each of the side frame members has a lower flange 56 extending outwardly therefrom in parallel relation to the upper flange thereof. Each of the side frame members has a plurality of rectangular mounting slots 57 extending therethrough in spaced relation to each other as can perhaps best be seen in FIGS. 1 and 2. Each of the mounting frames has a plurality of secondary mounting slots 58 individually extending therethrough above the respective mounting slots 57.

Figure 2:
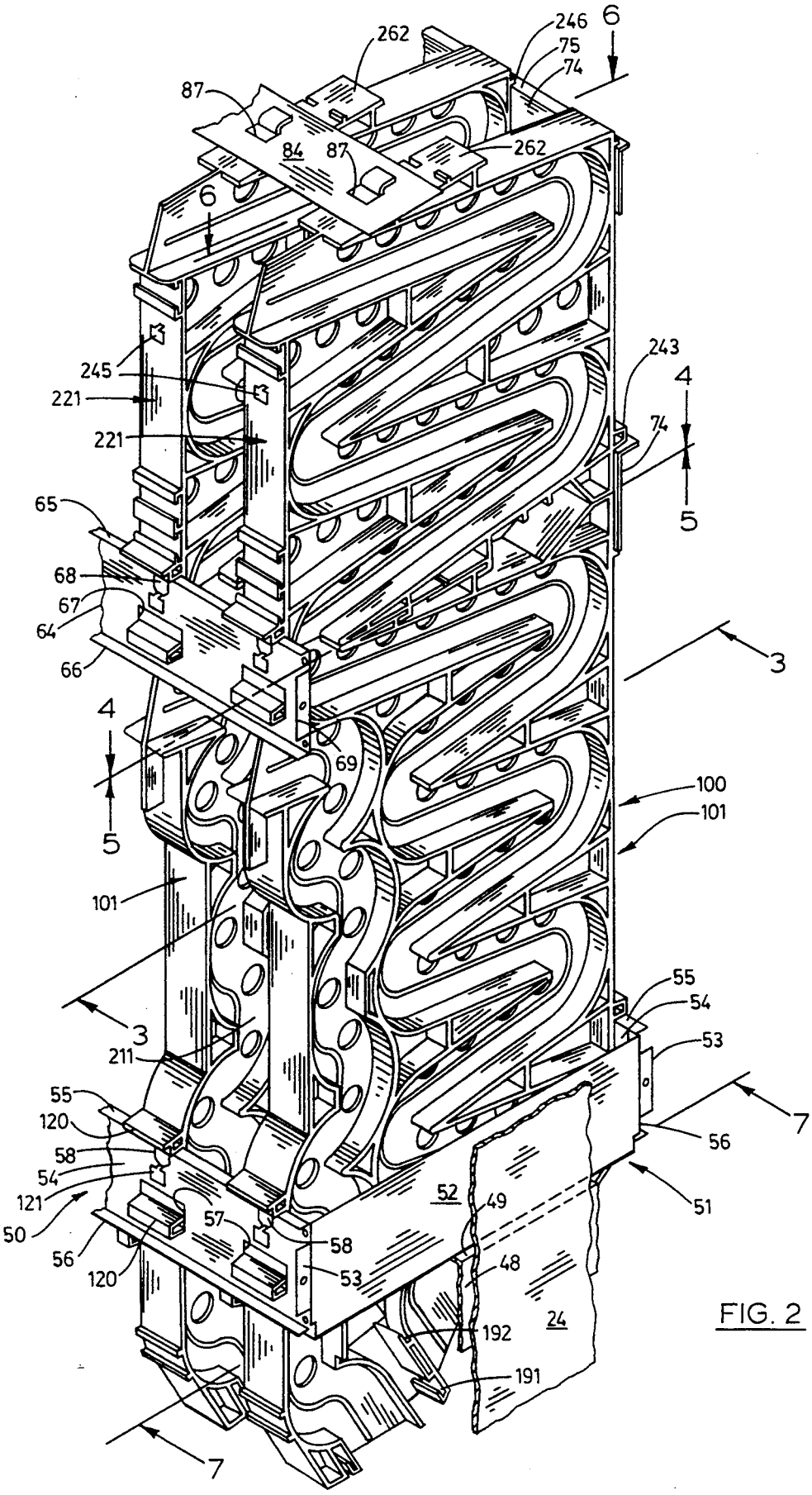
FIG. 2 is a somewhat enlarged, fragmentary perspective view of a portion of the subframe of the apparatus of the present invention mounted within the vending machine and taken from a position indicated by line 2—2 in FIG. 1.

The main frame 50 of the apparatus 10 includes a central frame member 64 extending between the opposite side walls 24 of the housing 22 in upwardly spaced, substantially parallel relation to the side frame member 54 nearest the door assembly 35 of the vending machine 20. The central frame member has an upper flange 65 disposed in substantially right angular relation to the central frame member 64 and a lower flange 66 substantially parallel to the upper flange and thereby right angularly related to the central frame member. The central frame member has a plurality of rectangular mounting slots 67 extending therethrough in spaced relation to each other, as best shown in FIGS. 1 and 2. The central frame member has a plurality of secondary mounting slots 68 extending therethrough individual in upwardly spaced relation to the mounting slots 67. The central frame member 64 is mounted on the opposite side walls by mounting tabs 69 using suitable fasteners such as screws, not shown.

The main frame 50 includes other frame members hereinafter described which are not attached to the side walls 24 of the housing 22, but which are attached to other portions of the apparatus 10 hereinafter described. Thus, the main frame has a pair of rear frame members 74. The rear frame members have upper flanges 75 right angularly related to the respective rear frame members and a plurality of mounting slots 77 extending therethrough in spaced relation and in positions corresponding to the mounting slots 57 of the side frame members 54 and the mounting slot 67 of the central frame member 64. The main frame 50 has a top frame member 84 having a plurality of mounting slots 87 extending therethrough in positions corresponding to those of the mounting slots 77 of the rear frame members 74.

Figure 3:
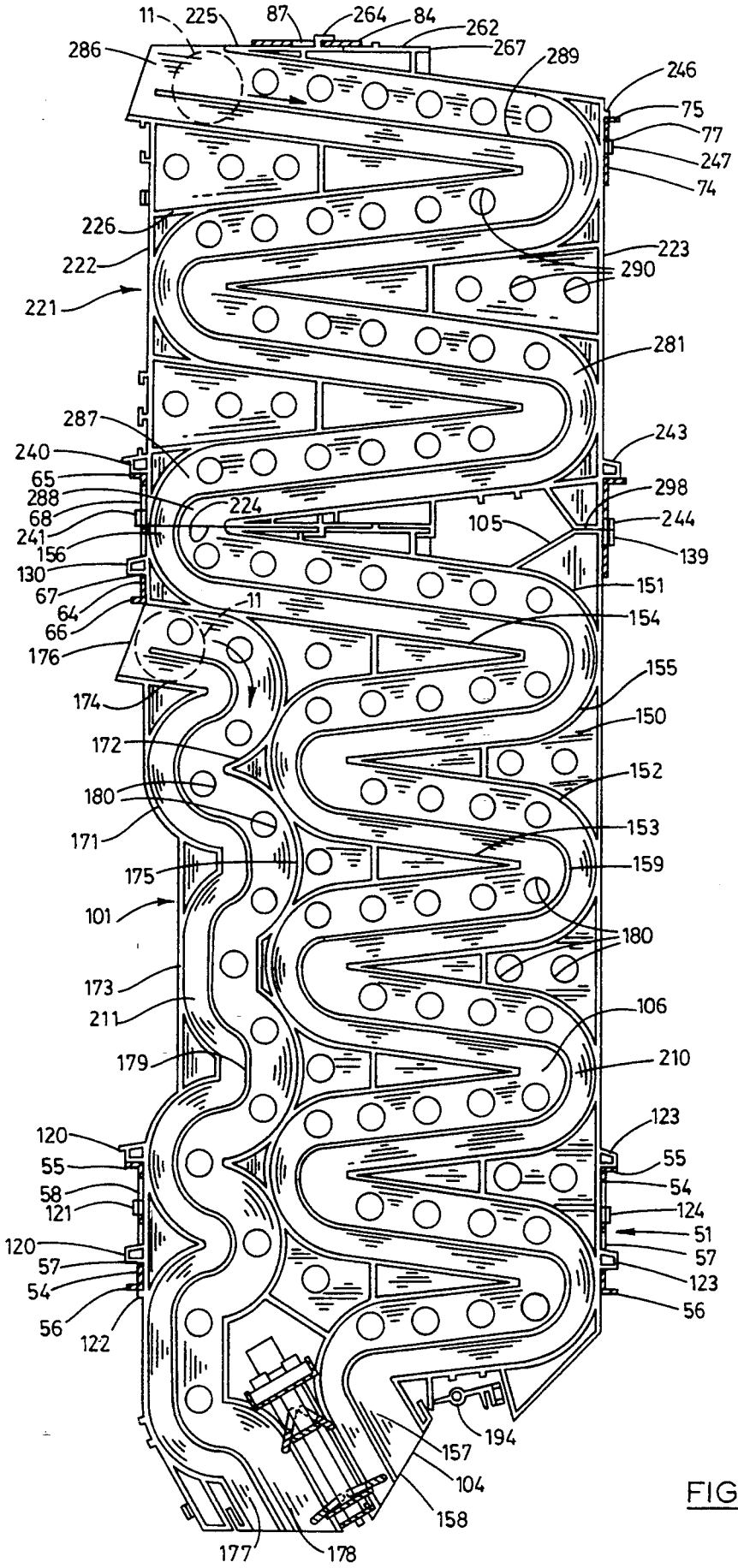
FIG. 3 is a vertical section of the subframe of FIG. 2 taken on line 3—3 in FIG. 2.

The apparatus 10 includes a subframe 100, best shown in FIG. 1. The subframe is mounted in the main frame 50 of the apparatus, as will hereinafter be described in greater detail, and includes a plurality of lower modules 101. The lower modules can be constructed in a wide variety of specific configurations, as will hereinafter be set forth in greater detail. The illustrative embodiment shown and described herein is representative of only one such configuration. Each of the lower modules is preferably constructed of a suitable molded plastic material such as rigid industrial grade polypropylene block copolymer, or rexene resin PP14B12A CS-253, or an equivalent thereof. The lower modules are preferably substantially identical being produced from the same mold, or identical molds, and possessing all of the structure hereinafter described. Each lower module has a front surface 102 and an opposite rear surface 103. Each lower module has a lower surface 104 and an opposite upper surface 105. Each lower module has a right side 106 and an opposite left side 107. The front surface 102 of each lower module 101 mounts a pair of spaced, substantially parallel lower front projections 120 disposed in predetermined spaced relation. The front surface of each module also mounts a hook 121 between the lower front projections and a rib 122 in spaced relation to the lower most front projection 120 as can best be seen in FIG. 3. The rear surface 103 of each lower module mounts a pair of lower rear projections 123 disposed in predetermined spaced relation to each other, as best shown in FIG. 3. The rear surface of each lower module mounts a hook 124 in a predetermined position between the lower rear projections 123.

Each lower module 101 mounts an upper front projection 130 on the front surface 102 thereof in a predetermined position adjacent to the upper surface 105 of the lower module. A rib 131 is mounted on the front surface of each lower module in predetermined spaced relation to and below the upper front projection 130 thereof. The upper surface 105 of each lower module mounts a substantially flat upper mounting plate 132, best shown in FIG. 4. The upper mounting plate has a substantially rectangular hook opening 133 and a laterally disposed upwardly extending hook 134. The upper mounting plate has a slot 135 and a laterally disposed projection 136 extending upwardly therefrom. The upper mounting plate forms a lip 137 and has an upwardly extending rest 138 having an upper surface disposed in the same plane as the upper mounting plate. The rear surface 103 of each lower module mounts a rear hook 139, best shown in FIG. 3.

The lower modules 101 are removably mounted on the main frame 50 in side-by-side relation as best shown in FIGS. 1 and 2. In the preferred embodiment of the invention, each of the lower modules is mounted on the main frame simply by being interlocked with the main frame, as will hereinafter be described, and not by any other means of attachment. For each such lower module, the lower most of the lower front projections 120 is received in its respective mounting slot 57 of the front side frame member 54. The rib 122 engages the lower flange 56. The hook 121 is received in the secondary mounting slot 58. The upper most of the lower front projects 120 is rested on the upper flange 55 of front side frame member 54. In the case of the rear side frame member 54 on the right as viewed in FIG. 3, each lower module is attached thereto by extension of the lower most of the lower rear projections 123 through the mounting slot 57. The hook 124 is extended through the secondary mounting slot 58. The upper most of the lower rear projections 123 is rested on the upper flange 55 of the rear side frame member.

In the case of the central frame member 64, each lower module is attached thereto by insertion of the upper front projection 130 therethrough. The rib 131 engages the lower flange 66 of the central frame member. Thus, it will be seen that each lower module is securely, but removably, retained in the described mounted position on the main frame. The interlocking assembly not only ensures that each module is securely mounted in position, but also ensures that the lower modules are precisely oriented relative to each other and the rest of the apparatus for precise and dependable operation.

Each lower module 101 has a central wall 150 which may be viewed as dividing the right side 106 and left side 107 of the module. Except as otherwise provided herein, the right side and the left side of each lower module are identical. Each side has a first serpentine track 151, perhaps best shown in FIG. 3, defined by a right wall 152 and a left wall 153 disposed in predetermined spaced relation thereto. The right and left walls of the first serpentine tracks of each lower module extend outwardly from the central wall in opposite directions on the right side and left side of the lower module. Each wall of each first serpentine track may be viewed as formed from sloped segments 154 and curved segments 155 arranged so as to define the first serpentine track. Each first serpentine track has an entrance opening 156 in the upper surface 105 of each lower module and an opposite discharge passage 157 leading to a discharge opening 158. A serpentine rib 159 is formed on the central wall within each first serpentine track extending a short distance into the track from the surface of the central wall.

As previously noted, the lower modules 101 can be constructed in a wide variety of specific configurations. Each lower module can thus have one, two or more serpentine tracks on the right side 106 and left side 107 thereof. In the illustrative embodiment hereof the lower module has a second serpentine track 171 extending outwardly from the central wall 150 on the right side and left side thereof. Each second serpentine track is defined between a right wall 172 and a left wall 173 disposed in predetermined spaced relation thereto. The left and right walls of each second serpentine track may be viewed as composed of sloped segments 174 and curved segments 175 so arranged as to define the second serpentine track. Each second serpentine track has an entrance opening 176 and an opposite discharge passage 177 leading to a discharge opening 178. A serpentine rib 179 extends outwardly from the central wall into each second serpentine track a short distance, as best shown in FIG. 3. The central wall 150 has a plurality of air holes 180 extending therethrough in positions best shown in FIG. 3, for purposes of enhancing the effects of refrigeration upon the work objects stored therein.

The discharge passages 157 and 177 of the respective first and second serpentine tracks 151 and 171 on the right side 106 and left side 107 of each lower module bound an operational position 190. The left wall 153 of the first serpentine track 151 mounts an upwardly facing lower mounting lip 191 and an upwardly facing upper mounting lip 192, as best shown in FIG. 2. Right wall 152 of the first serpentine track and the left wall 173 of the second serpentine track mount a pair of clip ribs 193 adjacent to their respective discharge passages 157 and 177. The clip ribs of each pair are disposed in predetermined spaced relation to each other. Each lower module 101 is molded so as to provide a stop clip 194 held in place on the lower surface 104 of the lower module by mold flashing 195. The flashing is sufficiently thin that the stop clip can be broken free from the flashing for use, as will subsequently be described. The stop clip has a handle 196 and clip 197 defining a clip slot 198. A stop 199 is mounted on and extends frown the clip 197.

As can perhaps best be visualized in FIG. 2, the subframe 100 is composed of a plurality of lower modules 101 mounted on the main frame 50 in side by side relation. In the described embodiment, there are seven lower modules disposed in side by side relation. Each lower module is mounted in its respective position as previously described. Referring more particularly to FIG. 2, each pair of lower modules 101 is disposed in upstanding relation on the main frame, with the lower modules of the pair disposed in spaced, substantially parallel relation to each other. The corresponding first serpentine tracks 151 of the lower modules of the pair thus face each other and can be viewed as defining a first work object storage area 210 which includes the space within each first serpentine track and the vacant area extending therebetween. Similarly, the second serpentine tracks 171 of the lower modules of the pair can be viewed as defining a second work object storage area 211 which includes the space within each second serpentine track and the vacant area extending therebetween. If desired, the first and second serpentine tracks can be so dimensioned as to house containers of different diametric dimensions.

In the illustrative embodiment hereof, the work objects 11 are substantially cylindrical beverage containers. For work objects of this type, the right wall 152 and left wall 153 of the first serpentine track and the right wall 172 and left wall 173 of the second serpentine track 171 are spaced from each other so as to be slightly further apart than the diametric dimension of the containers to be deposited therein. Similarly, the distance between the central walls 150 of the lower modules of the pair are spaced from each other a distance slightly greater than the length or axial dimension of the containers. The lower modules of the pair are thus adapted to receive through the entrance openings 156 of the first and second serpentine tracks a plurality of the work objects, in this case cylindrical beverage containers, so that an end portion of each container is received in the corresponding serpentine tracks of the pair of lower modules extending through the vacant area therebetween. Thus, a plurality of such containers can be deposited in the serpentine tracks and will gravitionally move therealong until a plurality of such work objects are received in the first and second work object storage areas. It will be understood, for illustrative convenience, that in the case of the beverage container work objects, the containers of the first work object storage area contain a beverage different from the containers housed in the second work object storage area 211. The serpentine ribs 159 and 179 relieve the ends of the containers from full contact with the central walls 150.

The subframe 100 includes a plurality of upper modules 221. An upper module is mounted on the main frame 50 above and in feeding relation to each lower module 101. Each upper module is preferably constructed of a molded plastic material such as that from which the lower modules are fabricated. Each upper module has a front surface 222, a rear surface 223, a lower surface 224 and an upper surface 225. Each upper module can be viewed as having a right side 226 and an opposite left side 227. The front surface of each upper module has a lower front projection 240 and a hook 241. The rear surface 223 of each upper module mounts a lower rear projection 243 and a lower rear hook 244. An upper hook 245 is mounted on the front surface of each upper module in a predetermined position. An upper rear rib 246 is mounted on the rear surface of each upper module in a predetermined position. A hook 247 is mounted on the rear surface of each upper module a predetermined distance below the upper rear rib 246 thereof.

Each upper module 221 mounts an upper mounting plate 262 coincident with the upper surface 225 of the upper module. As can best be seen in FIG. 6, the upper mounting plate mounts a rectangular hook opening 263. A hook 264 extends upwardly from the upper mounting plate laterally disposed relative to the hook opening. A slot 265 is formed in the upper mounting plate. A projection 266 extends upwardly from the upper mounting plate laterally disposed relative to the slot 265. The upper mounting plate defines a lip 267.

Each upper module 221 has a central wall 280 centrally interposed between the right side 226 and left side 227 of the upper module. As with the lower modules 101, the opposite sides of each upper module are, except as otherwise noted herein, identical. However, each side of the upper module mounts only one serpentine track 281 in the illustrative embodiment. The serpentine track is defined by a right wall 282 and a left wall 283 spaced therefrom the same distance as the right wall 152 and left wall 153 of the first serpentine track 151 of each lower module 101. The right and left walls of the serpentine track 281 can be viewed as composed of sloped segments 284 and curved segments 285 so arranged as to form the serpentine track. Each serpentine track has an entrance opening 286 and an opposite discharge passage 287 extending through the lower surface 224 of the upper module through a discharge opening 288. A serpentine rib 289 extends a short distance from the central wall into the serpentine track between the right and left walls thereof. A plurality of air holes 290 extend through the central wall 280 in the positions best shown in FIG. 3.

Each upper module 221 has a lower mounting plate 292. As shown in FIG. 5, the lower mounting plate has a rectangular hook opening 293 therein and a first hook 294 extending downwardly from the lower mounting plate laterally disposed relative to the hook opening 293. Similarly, a slot 295 is formed in the lower mounting plate and a projection 296 extends downwardly from the lower mounting plate in laterally disposed relation to the slot 295. A second hook 297 extends downwardly from the lower mounting plate. A rest 298 is disposed in rearwardly spaced relation to the lower mounting plate 292.

As best shown in FIGS. 1, 2 and 3, an upper module 221 is mounted immediately above and in alignment with each lower module 101. Each upper module is positioned relative to its respective lower module by placing the lower mounting plate 292 of the upper module in interlocking engagement with the upper mounting plate 132 of its respective lower module. In this interlocked relationship, the hook 134 of the lower module extends through the hook opening 293 of the lower mounting plate 292 of the upper module, the hook 294 of the lower mounting plate of the upper module extends through the hook opening 133 of the upper mounting plate of the lower module. Thus, the hooks engage the respective mounting plates of their respective other modules. The projection 296 is received in the slot 135 and the projection 136 is received in the slot 295. The second hook 297 engages the lip 137. Similarly, the rest 138 of the lower module is placed in facing engagement with the rest 298 of the upper module. Still further, the hook 241 of the upper module extends through the secondary mounting slot 68 of the central frame member 64. The lower front projection 240 is rested on the upper flange 65 of the central frame member 64. The hook 247 is extended through its respective mounting slot 77 in its respective upper rear frame member 74. The hooks 139 and 244 are extended through their respective mounting slots 77 in the lower rear frame member 74. Finally, the hook 264 is extended through the mounting slot 87 of the top frame member 84 and hooked thereon, as best shown in FIG. 3.

The ends of the upper and lower rear frame members 74, the top frame member 84 and the rear side frame member 54 are not attached in any way to the housing 22 of the vending machine 20. However, their respective opposite ends are in close proximity to the opposite side walls 24 of the housing, the spacing being about one eighth inch (⅛"). This close proximity permits the housing to retain the subframe 100 and all the components thereof in proper alignment during transport of the vending machine and during insertion and removal of the main frame and subframe from the housing. To reiterate, the main frame 50 and subframe 100 are only attached to the housing by the end frame members 52 resting on the horizontal surfaces 49 of the brackets 48 individually mounted on the opposite side walls 24 and by the screws extending through the forward mounting tabs 53 of the end frame members and the mounting tabs 69 of the central frame member 64. Accordingly, upon removal of these screws from the mounting tabs, the main frame 50 and subframe 100 can readily be installed and removed by sliding on the horizontal surfaces of the brackets.

As can perhaps best be visualized upon reference to FIG. 3, each upper module is interlocked with its respective lower module and the serpentine track 281 on each side thereof constitutes an upward extension of the first serpentine track 151 on the corresponding side of the lower module so as, in effect, to extend the first work object storage area 210 thereof upwardly thereabove. Thus, the discharge opening 288 of the serpentine track 281 is disposed in feeding relation to the entrance opening 156 of the first serpentine track 151. As a consequence, the first work object storage area 210 defined by the upper and lower modules of each pair has substantially greater capacity than the second work object storage area 211 defined only by the lower modules of the pair. As with the lower modules, the upper modules are mounted in pairs above their respective lower modules.

The preferred embodiment of the invention has seven upper modules 221 individually so mounted above seven lower modules 101. Since the opposite sides of each upper module are identical, the seven upper modules and seven lower modules mounted on the main frame 50 in the described embodiment and as shown in FIG. 1, define six compartments individually between adjacent pairs of upper and lower modules. The first such compartment visible in FIGS. 3, 4, 5, 6 and 7A through 7E has the first and second work object storage areas 210 and 211 heretofore described. The remainder of the compartments have the combinations of work object storage areas represented in the schematic diagram of FIG. 10 hereinafter to be described in greater detail. However, it will be understood that the six compartments could have any desired combination of work object storage areas.

Figure 8:
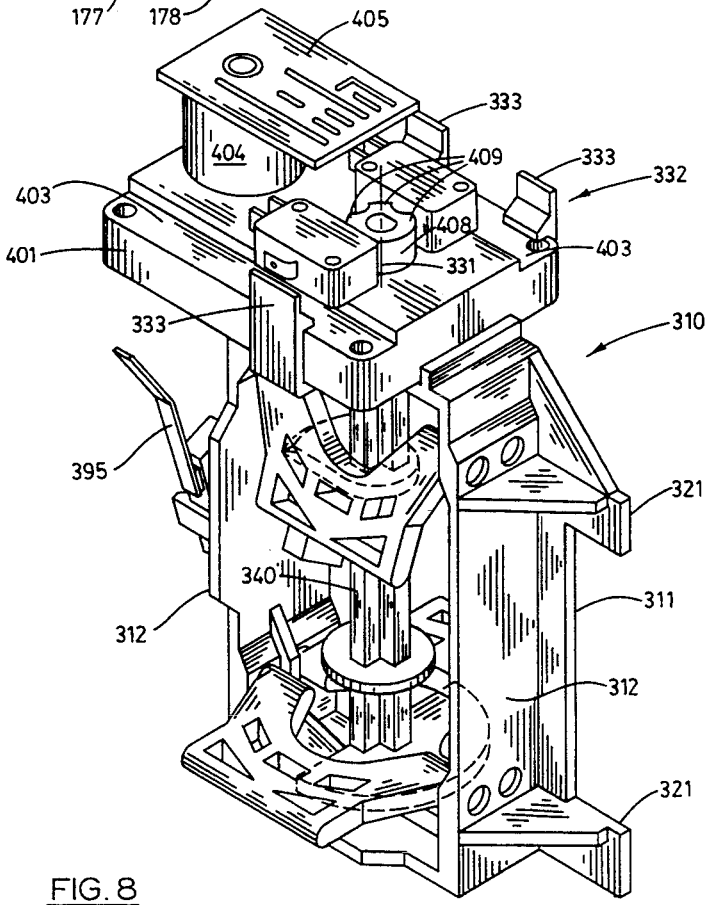
FIG. 8 is perspective view of the vend mechanism of the apparatus of the present invention.

The vend mechanism of the apparatus 10 of the present invention is generally indicated by the numeral 310 in FIG. 8. The vend mechanism includes a vend frame 311 which is preferably constructed of a molded plastic material. The vend frame has opposite side walls 312 disposed in spaced, substantially parallel relation to each other linked by opposite end walls 313 interconnecting the opposite side walls and spaced in substantially parallel relation. Each opposite side wall has a pair of upper passages 314 extending therethrough in predetermined positions and a pair of lower passages 315 extending therethrough also in predetermined positions. Corresponding upper and lower passages of the respective opposite side walls define axes of rotation extending through the vend frame in right angular relation to the opposite side walls. The opposite side walls and opposite end walls bound a cam shaft compartment 316 therewithin.

Each of the opposite side walls 312 mounts a side frame 320 in turn mounting a pair of mounting flanges 321. The side wall 312 on the left as viewed in FIG. 9 mounts a pair of interior mounting pins 322 extending into the cam shaft compartment in predetermined positions. A mounting clip 323 is mounted on the same side wall and extends inwardly of the cam shaft compartment adjacent to the interior mounting pins in predetermined relation thereto. The same exterior side wall 312 on the left in FIG. 9 mounts a pair of exterior mounting pins 324 extending outwardly from the side wall in predetermined positions. A mounting clip 325 is mounted on and extends outwardly from the same opposite side wall on the left as viewed in FIG. 9 in predetermined relation to the exterior mounting pins 324.

The opposite end walls 313 of the vend frame 311 individually mount cam shaft bearing sleeves 330 which define an axis of rotation 331 extending through the cam shaft compartment 316 substantially parallel to and between the opposite side walls 312 of the vend frame. The upper most opposite end wall 313 of the vend frame shown in FIG. 9 mounts a motor mounting assembly generally indicated by the numeral 332. The motor mounting assembly includes three clip arms 333 extending outwardly and thence endwardly from the end wall in predetermined spaced relation to each other. Each clip arm mounts a clip 334. A stop 335 is mounted on the end wall 313 in the position shown in FIG. 9.

The vend mechanism 310 includes a cam shaft 340 having an upper end portion 341. The upper end portion mounts an annular shoulder 342 from which is extended a pivot shaft 343. The cam shaft has a lower end portion 344 having an annular shoulder 345 from which is extended a pivot shaft 346. A grasping head 347 is mounted on and extended from the pivot shaft 346. The pivot shaft 343, the pivot shaft 346 and the grasping head 347 define a common longitudinal axis for the cam shaft.

An upper cam member 360 is mounted on and extended from the cam shaft in a predetermined position and has an arcuate beveled cam surface 361. A lower cam member 362 is mounted on the cam shaft in a predetermined location adjacent to the shoulder 345 and has an arcuate rounded cam surface 363 shown best in FIG. 9. An annular flange 364 is mounted on the cam shaft in a predetermined position between the upper and lower cam members, but nearest the lower cam member. The annular flange is concentric to the longitudinal axis of the cam shaft.

The vend mechanism 310 has a pair of upper control members 375 each having oppositely extending pivot shafts 376, an arcuate recess 377 and a rounded contact surface 378. The upper control members are individually mounted for pivotal movement with the pivot shafts thereof individually received in the pair of upper passages 314. The upper control members extend across the cam shaft compartment 316 for pivotal movement between depending positions within the cam shaft compartment and positions extending outwardly therefrom. A pair of lower control members 379 each have oppositely extending pivot shafts 380, an arcuate recess 381 and a rounded contact surface 382. The lower control members are individually received for pivotal movement with the pivot shafts thereof received in the pair of lower passages 315 for pivotal movement between positions extending in opposite directions at oblique angles downwardly from the cam shaft compartment 316 and positions extending directly outwardly from a cam shaft compartment in opposite directions.

Figure 9:
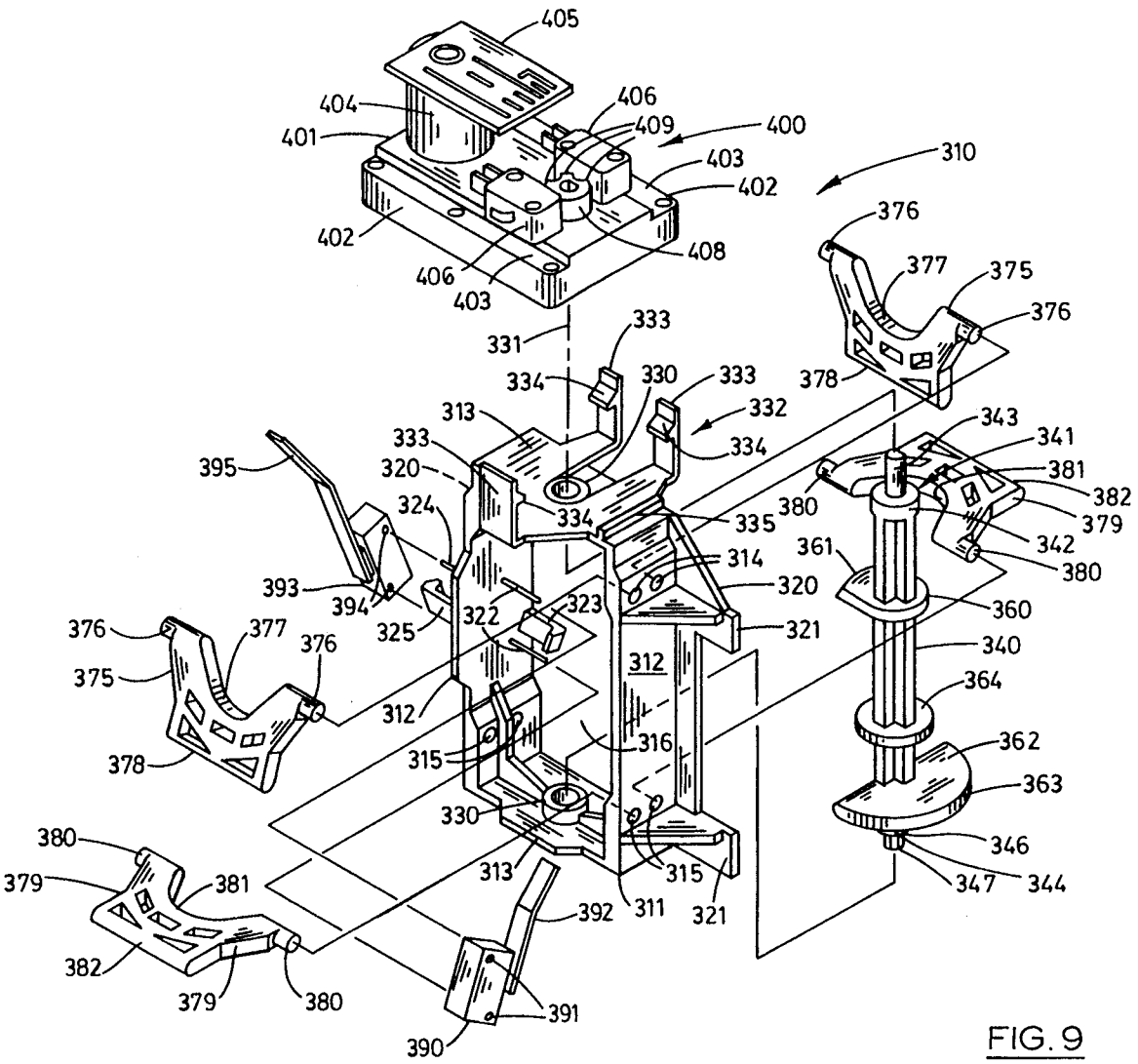
FIG. 9 is an exploded perspective view of the vend mechanism of the apparatus of the present invention shown in FIG. 8.

An interior micro switch 390 is mounted on the side wall 312 of the vend frame 311 on the left, as viewed in FIG. 9. The interior micro switch has a pair of mounting passages 391 extending therethrough through which are individually extended the interior mounting pins 322. The interior micro switches held in position on the interior mounting pins in facing engagement with the side wall 312 by the mounting clip 323 being snapped thereover. The interior micro switch has a trip arm 392 which extends outwardly of the cam shaft compartment as visible in FIGS. 7A through 7E. An exterior micro switch 393 is mounted on the external side of the side wall 312 on the left as viewed in FIG. 9. The exterior micro switch has a pair of mounting passages 394 through which are individually extended the exterior mounting pins 324. The exterior mounting switch is moved into facing engagement with the side wall and held in position by the mounting clip 325 being snapped thereover. The exterior micro switch has a trip arm 395 which extends to the left as viewed in FIGS. 7A through 7E. The micro switches 390 and 393 could, of course, be mounted in any other suitable positions on the vend frame.

A vend motor assembly 400 is releasably mounted on the motor mounting assembly 332. The vend motor assembly includes a gear box 401 having a pair of laterally extending side rails 402 with inwardly facing surfaces 403. An electrical motor 404 of suitable power is mounted on the gear box in driving relation thereto and in turn mounts a printed circuit board 405 containing a portion of the logic circuit for the apparatus. The remaining portion of the logic circuit is contained within the remainder of the electronic control system, not shown. A pair of micro switches 406 are mounted on the gear box adjacent to the motor 404 and each have trip members 407 disposed in spaced relation and aligned transversely of the gear box. A cam member 408 is mounted on the gear box in driven relation between the trip members of the micro switches. The cam member mounts lobes 409 so positioned as to be able to engage and operate the trip members of the micro switches. The vend motor assembly is releasably mounted on the motor mounting assembly 332 by spreading the clip arms, pressing the gear box downwardly over the exposed pivot shaft 343 of the cam shaft 340 in driving relation thereto and then releasing the clip arms. The upper surfaces 403 of the side rails 402 are thus engaged by the clips 334 and the gear box engages the stop 335. Thus, the vend motor assembly is releasably held into position by the clips 334 engaging the upper surfaces 403 of the side rails 402.

In the preferred embodiment of the invention there is one vend mechanism 310 for each pair of upper and lower modules 221 and 101 defining first and second work object storage areas 210 and 211 respectively. Each vend mechanism is mounted in the operational position therefore shown in FIGS. 7A through 7E by the mounting flanges 321 of the side frames 320 being slidably positioned in and supported on the lower and upper mounting lips 191 and 192 of the lower modules of the pair so as to extend across the space between the lower modules. Thus, it will be seen that the vend mechanism is held in position only by gravity. In addition, it will be seen that when viewed as shown in FIGS. 7A through 7E, the vend mechanism occupies the space between the first and second work object storage areas 210 and 211.

As previously noted, the apparatus 10 of the present invention can be constructed in embodiments with one, two, three, or more work object storage areas within each compartment defined by an adjacent pair of upper and lower modules. In the case of an embodiment in which an adjacent pair of upper and lower modules define one work object storage area, one vend mechanism 310 is mounted in the described position, but need have only a single upper control member 375 and lower control member 379 extending into the one work object storage area. In the described embodiment having two work object storage areas, the structure of the vend mechanism is as above set forth. In the case of an embodiment in which an adjacent pair of upper and lower modules define three work object storage areas, two of the work object storage areas have a vend mechanism of the structure of the described embodiment hereof and the third work object storage area has a vend mechanism of the structure above set forth relative to the embodiment having one work object storage area.

In the preferred embodiment of the invention herein set forth, the adjacent pairs of lower modules 101 and upper modules 221 define different combinations of work object storage areas; that is, the six (6) compartments do not each have the same number of work object storage areas. The specific combination of work object storage areas is depicted in the schematic diagram of FIG. 10. As shown therein, the apparatus 10 of the present invention defines a vending area 420 for the vending machine 20. The vending area is divided by the adjacent pairs of upper and lower modules 221 and 101, respectively, into six compartments. More specifically, the first adjacent pair of upper and lower modules, shown in FIGS. 2, 3, 4, 5, 6 and 7A through 7E, define a first compartment 421 therebetween containing the first and second work object storage areas 210 and 211 therebetween. The second adjacent pair of upper and lower modules shown in FIG. 1 from the right define a second compartment 422. The third adjacent pair of upper and lower modules define a third compartment 423. The fourth adjacent pair of upper and lower modules define a fourth compartment 424. The fifth adjacent pair of upper and lower modules define a fifth compartment 425. The sixth adjacent pair of upper and lower modules define a sixth compartment 426.

Figure 10:
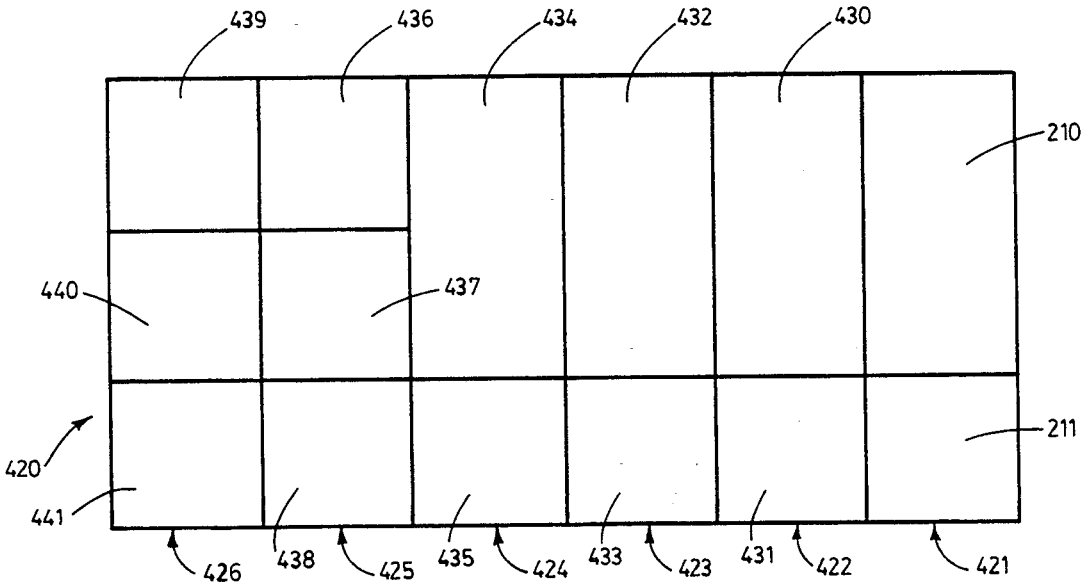
FIG. 10 is a schematic diagram of a representative apportionment of storage space within a vending machine made possible by the apparatus of the present invention.

Referring more particularly to FIG. 10, as previously noted the first compartment 421 contains the first work object storage area 210 and the second work object storage area 211. The second compartment 422 contains a first work object storage area 430 and a second work object storage area 431. The third compartment 423 contains a first work object storage area 432 and a second work object storage area 433. The fourth compartment 424 contains a first work object storage area 434 and a second work object storage area 435. The fifth compartment 425 contains a first work object storage area 436, a second work object storage area 437 and a third work object storage area 438. Similarly, the sixth compartment contains a first work object storage area 439, a second work object storage area 440 and a third work object storage area 441. Thus, the first four compartments each have two work object storage areas identical to the first and second work object storage areas 210 and 211, respectively. The last two compartments each have three work object storage areas.

In this configuration of the preferred embodiment illustrated in the schematic diagram of FIG. 10, the specific capacity of the apparatus 10 and of each work object storage area is dependent upon the capacities desired. By way of illustration it will be understood that in the preferred embodiment of the present invention the total capacity of the apparatus totalling the individual capacities of the six compartments 421, 422, 423, 424, 425 and 426 is four hundred and forty four (444) work objects 11. In this configuration, the first work object storage areas 210, 430, 432 and 434 of the first four compartments 421, 422, 423 and 424 each have a capacity of fifty-eight (58) work objects 11. The second work object storage areas 211, 431, 433 and 435 of the first four compartments each have a capacity of sixteen (16) work objects. The first work object storage areas 436 and 439 of the fifth and sixth compartments 425 and 426, respectively, each have a storage capacity of forty (40) work objects. The second work object storage areas 437 and 440 of the fifth and sixth compartments each have a capacity of eighteen (18) work objects. Finally, the third work object storage areas of the fifth and sixth compartments each have a capacity of sixteen (16) work objects. The total capacity of the apparatus in the described illustrative embodiment is thus four hundred and forty four (444) work objects.

OPERATION

The operation of the described embodiment of he subject invention is believed to be clearly apparent and is briefly summarized at this point. The apparatus 10 is loaded with work objects 11 by filling the work object storage areas of the first, second, third, fourth, fifth and sixth compartments 421 through 426, respectively. In the illustrative embodiment where the work objects are cylindrical containers of beverages and using the first compartment as an example, the first work object storage area 210 receives such containers of the beverage which is most popular while the second work object storage area 211 receives containers of a beverage which is less popular.

Referring more particularly to the schematic diagram of FIG. 10, the individual work object storage areas of the six (6) compartments provide four work object storage areas with individual capacities of fifty-eight (58) work objects; two work object storage areas with individual capacities of forty (40) work objects; two work object storage areas with individual capacities of eighteen (18) work objects; and six (6) work object storage areas of sixteen (16) work objects. Thus, the most popular selections are placed in the work object storage areas of largest capacity and the least popular in the work object storage areas of smallest capacity with the work object storage areas of intermediate capacity receiving selections of intermediate popularity. Furthermore, a plurality of work object storage areas may be electronically coupled through the electronic control system to increase the capacity of the most popular selection.

Since each pair of upper and lower modules 101 and 221, respectively, of the work object storage areas operate identically, for illustrative convenience the operation of only one such pair of upper and lower modules will be described herein; that is the upper and lower modules defining the first compartment 421. The work objects 11 are deposited in the first work object storage area 210 by insertion of the opposite ends of each work object individually through the entrance openings 286 of the serpentine tracks 281 of the upper modules 221 of the pair of modules. At this time, the vend mechanism 310 for the pair of upper and lower modules is in the state of adjustment shown in FIG. 7A. In this adjustment, the upper control members 375 are in the retracted positions and the lower control members 379 are in the extended positions as shown therein. Thus, the work objects roll down the serpentine tracks 281 of the upper modules of the pair, through the discharge openings 288 of the upper modules, into the entrance openings 156 of the lower modules and down the first serpentine tracks 151 to the positions shown in FIG. 7A where the first work object is retained by the lower control member 379 in the discharge passage 157. The work objects are stacked in sequence thereabove in the first work object storage area 210. Preferably, the first work object storage area is completely filled with the work objects so that its maximum capacity of fifty-eight (58) is employed.

Similarly, the second work object storage area 211 is filled with work objects 11 of one of the least popular beverages. This is achieved by individually inserting the opposite ends of each successive work object through the entrance openings 176 of the second serpentine tracks 171 of the pair of lower modules 101. The lower control member 379 and the upper control member 375 are retained at this time in the positions shown in FIG. 7A so that the work objects move past the upper control member and engage the lower control member. Preferably, the work objects are deposited in sequence until the entire capacity of the second work object storage area 211 is filled with he work objects; that is sixteen (16) such work objects. All of the other work object storage areas of the other compartments are filled to capacity in the same manner as desired.

The apparatus 10 is now ready for use. The vending machine 20 is operated in what is otherwise a normal manner. The operator deposits payment and selects the work object desired by conventional means, not shown. Initiation of the vend cycle causes the vend motor assembly 400 to operate to rotate the cam shaft 340 about the axis of rotation 331 in the direction corresponding to the selection made by the operator. For illustrative convenience, it will be understood that the selection made by the operator is for a work object frown the first work object storage area 210. This initiates the vend sequence illustrated in FIG. 7B wherein the upper control member 375 on the right as viewed in FIG. 7B is extended by the upper cam member 360 into the discharge passage 157 of the first serpentine track 151. This action isolates the next successive work object in the discharge passage holding it within the passage so that it is not released during vending of the work object therebelow. Simultaneously, the lower control member 379 is released by the lower cam member 362 to pivot downwardly under the weight of the work object 11 rested thereagainst. Such movement is continued until the work object 11 falls gravitationally from the discharge opening 158 as illustrated in FIG. 7C. The work object falls gravitationally into the trough 39 along which it is fed into the vending bin 36. The operator can then retrieve the work object from the vending machine through the opening 37 thereof. It will be seen that during this sequence of operations depicted in FIGS. 7A through 7C, the work objects 11 in the second work object storage area 211 are retained in the stored position by engagement of the lower cam member 362 with the lower control member 379 thereof.

Figure 7A:
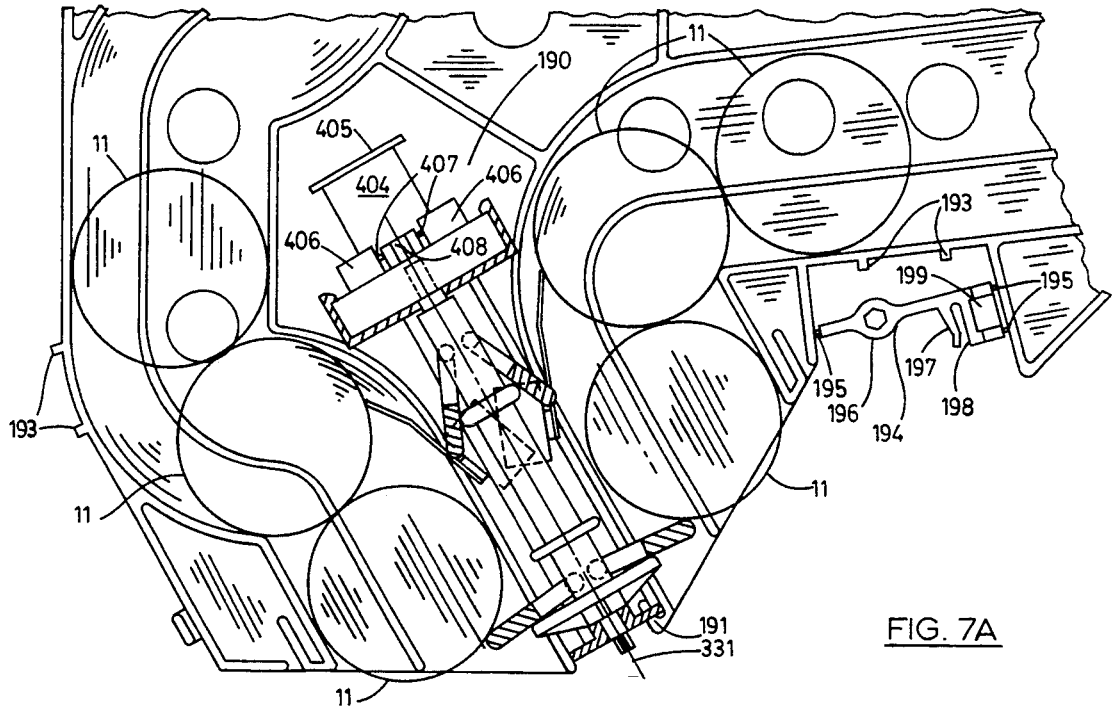
FIG. 7A is a still further enlarged, fragmentary vertical section taken on line 7—7 in FIG. 2 and showing the vend mechanism of the apparatus of the present invention in a first stage of operation.
Figure 7B:
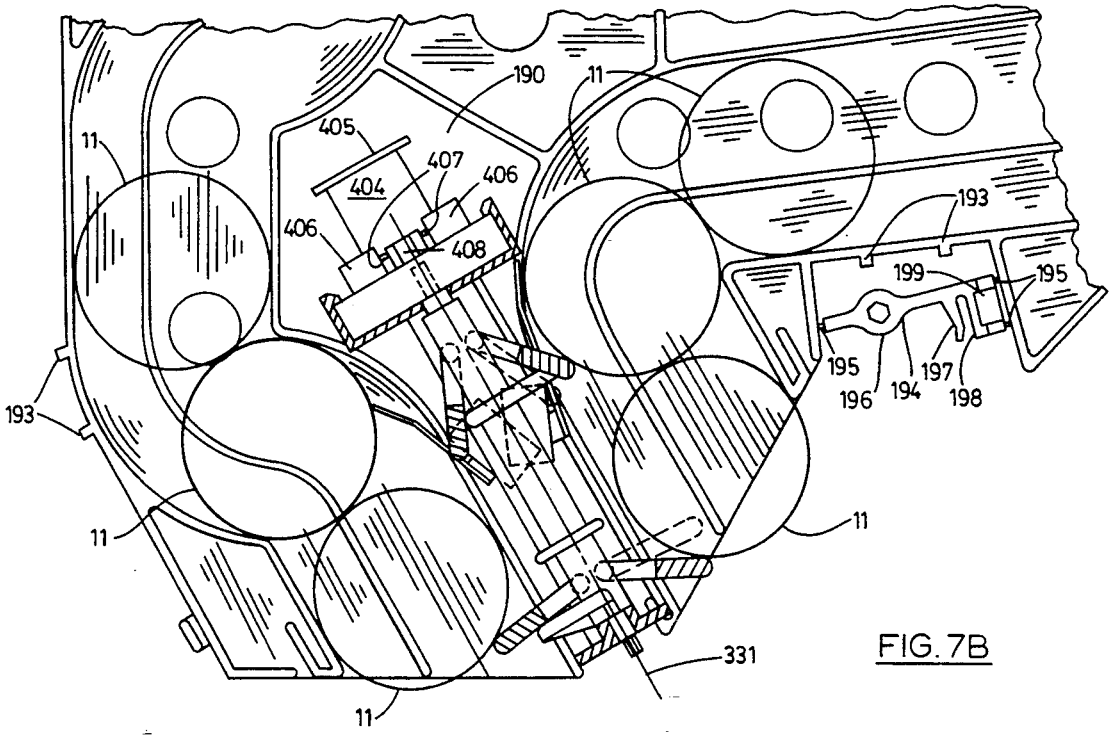
FIG. 7B is a still further enlarged, fragmentary vertical section taken on line 7—7 in FIG. 2 and showing the vend mechanism of the apparatus of the present invention in a second stage of operation.
Figure 7C:
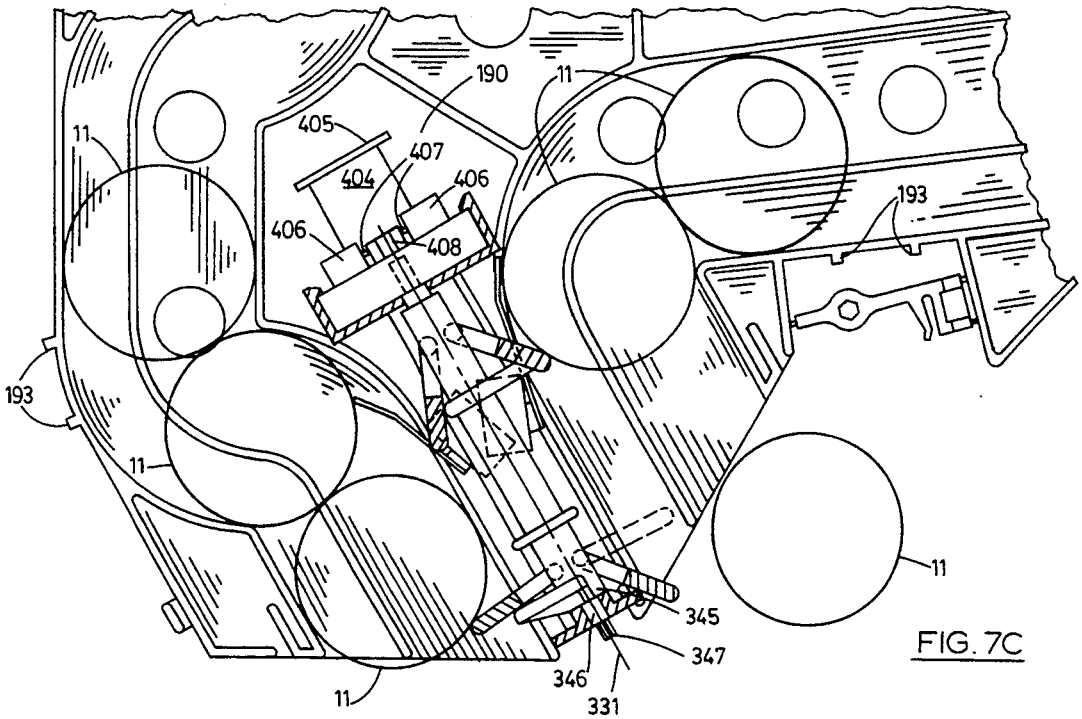
FIG. 7C is a still further enlarged, fragmentary vertical section taken on line 7—7 in FIG. 2 and showing the vend mechanism of the apparatus of the present invention in a third stage of operation.
Figure 7D:
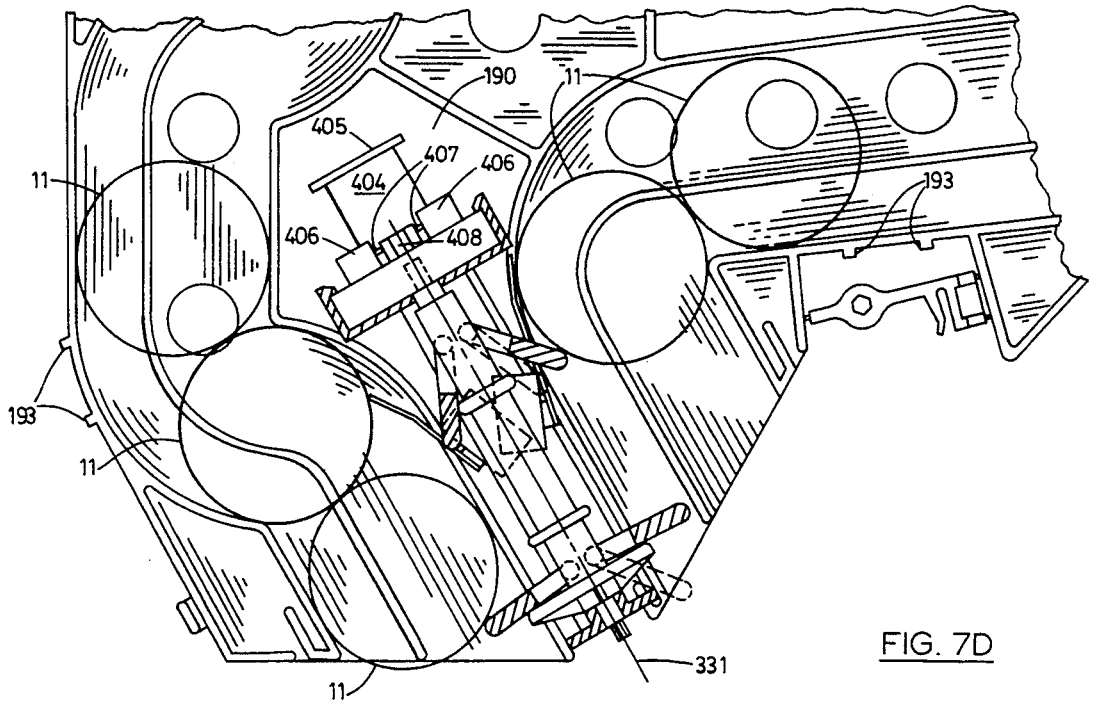
FIG. 7D is a still further enlarged, fragmentary vertical section taken on line 7—7 in FIG. 2 and showing the vend mechanism of the apparatus of the present invention in a fourth stage of operation.
Figure 7E:
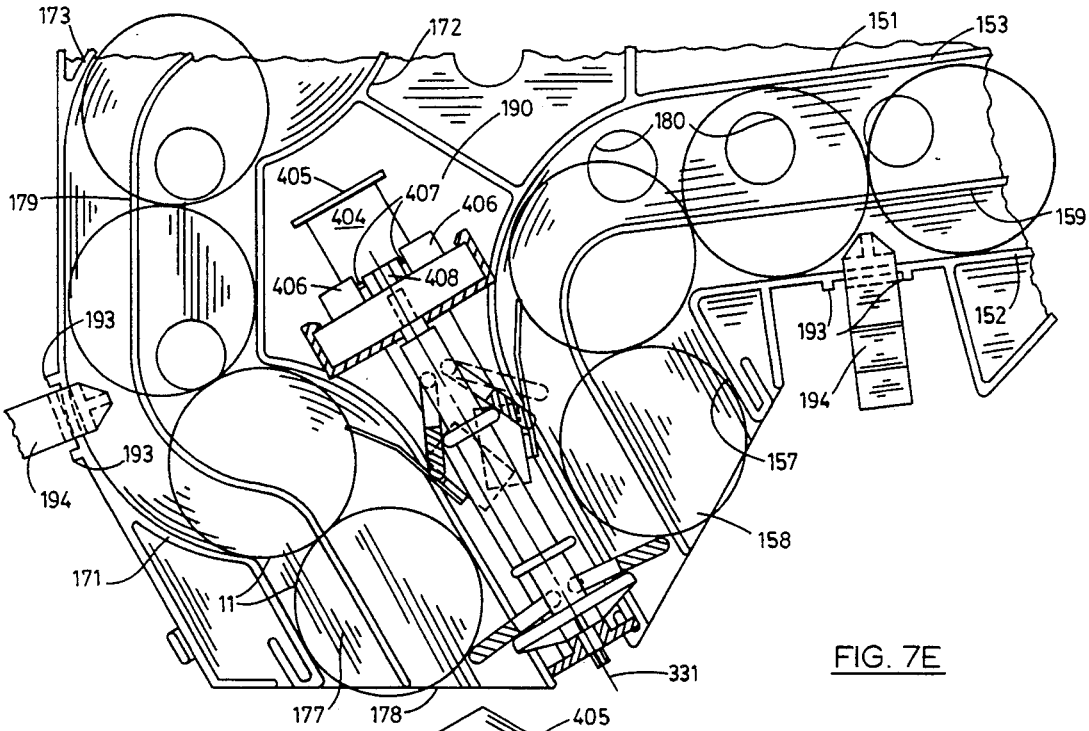
FIG. 7E is a still further enlarged, fragmentary vertical section taken on line 7—7 in FIG. 2 and showing the vend mechanism of the apparatus of the present invention in a fifth stage of operation.

Upon completion of this portion of the vend cycle, the vend motor assembly 400 stops, reverses direction and begins to return the cam shaft 340 to the "home" or "standby" position shown in FIG. 7A. During this return, the lower cam member 362 is brought into the position illustrated in FIG. 7D wherein the upper control members 375 are retracted and the lower control members 379 are extended into the area between the discharge passages. Under the weight of the work object rested thereon, the upper control member 375 of the first work object storage area pivots downwardly sufficiently to release the work object rested thereagainst to pass gravitationally downwardly in the first work object storage area until it comes into rested engagement with the lower control member 379 and is thus in position for a new vend cycle. Similarly, the work objects thereabove move gravitationally downwardly into side by side relation in the first work object storage area. This operation is depicted in FIG. 7E.

Operation of the vend cycle with respect to the second work object storage area 211 is identical to that heretofore described with the exception that the work objects therewithin are controlled by the upper control member 375 and lower control member 379 extending into discharge passage 177. Accordingly, it is not necessary to repeat this description relative to vending from the second work object storage area. It is important to note, however, that, as shown in the drawings and heretofore described, a single vend mechanism 310 simultaneously controls the vending of work objects from both the first and second work object storage areas 210 and 211. More specifically, the single vend mechanism can be operated independently to vend work objects from the first and second work object storage areas on demand. Since the cam shaft is always returned to the "home" or "standby" position shown in FIG. 7A before a new vend cycle can be initiated, the first and second work object storage areas 210 and 211 can individually be loaded with different work objects. The logic circuit of the electronic control system and printed circuit board 405 rotates the cam shaft from the home position in the direction of the work object storage area selected.

The interior micro switch 390 and exterior micro switch 393 operate to permit monitoring and control of the work objects 11 within the discharge passages 157 and 177 of the respective first work object storage area 210 and second work object storage area 211. The trip arms 392 and 395 respectively thereof extend into the discharge passages for engagement by the work objects causing the trip arms to be depressed and thereby operating the micro switches. Through the electrical control system, this information is transmitted for use in indicating on the face of the vending machine 20 when all of the work objects have been rended from either or both of the first work object storage area 210 and second work object storage area 211. Similarly, the trip members 407 of the micro switches 406 keep track of the position of the cam shaft 340 and thus the upper cam member 360 and lower cam member 362. As the cam shaft is pivoted about the axis of rotation 331 in either direction, the cam lobes 409 depress the trip members 407 of the micro switches 406 so as to indicate for the logic circuit of the electronic control system and printed circuit board 405 in what stage of the vending cycle the vend mechanism is relative to vending from the first or second work object storage areas 210 and 211.

When it becomes necessary to service or repair any of the vend mechanisms 310 of the apparatus 10, the door assembly 35 of the vending machine 20 is opened to gain access to the interior compartment 27. Since this operation is identical for each of the vend mechanisms of the first through sixth compartments 421 through 426, respectively, the operation relative to only one vend mechanism will be set forth. A pair of stop clips 194 are pulled free of the mold flashing 195 thereof on the pair of lower modules. As shown in FIG. 7E, the clip 197 of each stop clip 194 is slidably positioned over the wall defining the first serpentine track 151 and second serpentine track 171 between the clip ribs 193 thereof. More specifically, the clip of one of the stop clips 194 is slidably positioned over the right wall 152 of the first serpentine track between the clip ribs 193 thereof as shown in FIG. 7E. Similarly, the clip of the other stop clip 194 is slidably positioned over the left wall 173 of the second serpentine track 171 between the clip ribs 193 thereof. The stops 199 borne by the individual stop clips 194 extend into their respective tracks and are engaged by the work object thereabove. In order to release the work objects down stream from the stops, the operator grasps the grasping head 347, by hand or using a wrench or other hand tool, and pivots the cam shaft 340 until both lower control members are pivoted downwardly to release the work objects below the stops 199 from the discharge passages 157 and 177.

The vend mechanism 310 is then available for removal from the lower modules 101. This is accomplished simply by lifting upwardly on the vend frame 311 to move the mounting flanges 321 from the lower mounting lips 191 and upper mounting lips 192 respectively of the lower modules. The vend frame is then simply lowered from between the lower modules and removed from the subframe 100. The stop clips 194 retain all of the work objects thereabove in position during service or repair of the vend mechanism.

Since as previously described, the vend mechanism 310 is largely constructed of components which are clipped or snapped together, repair and service is readily accomplished. If, for example, the vend motor assembly 400 requires repair or replacement, the gear box 401 and associated elements can simply be released by pressing the clip arms 333 outwardly to permit the gear box 401 to be pulled free of the pivot shaft 343 of the cam shaft 340. A new vend motor assembly 400 can then be substituted therefore by a reversal of the foregoing steps or the existing vend motor assembly can be repaired or otherwise serviced and reinstalled, again by a reversal of the foregoing steps. With or without removal of the vend mechanism 310 from the pair of upper and lower modules, the cam shaft 340 can be pivoted about the axis of rotation 331 manually as desired by engaging the grasping head 347 by hand or with a suitable hand tool to achieve the amount of pivoting desired.

The vend mechanism 310 is reinstalled in the operational positions by sliding the mounting flanges 321 upwardly in the respective operational positions 190 and receiving them in the upper mounting lips 192 and lower mounting lips 191 gravitationally to support the vend mechanism in the described position. The stop clips 194 are then slidably removed from their respective positions between the clip ribs 193 of the first and second work object storage areas 210 and 211, respectively. This frees the entire stack of work objects above each stop clip gravitationally to move downwardly in their respective work object storage areas until they again engage the lower control members 379 as shown in FIG. 7A. Those work objects which were released from the discharge passages 157 and 177 can then be reinserted through the entrance openings 286 of the first work object storage area and entrance openings 176 of the second work object storage area as appropriate. The stop clips 194 can be stored for later use by moving the clips 197 thereof over any available flanges of the lower modules such as are visible in FIG. 3.

Referring again more particularly to the arrangement of the preferred embodiment of the apparatus depicted in FIG. 10, the capacities of the work object storage areas previously identified have a unique operative advantage never before achieved in the art. The most efficient operation of a vending machine would be to have all of the work object storage areas thereof require refilling at the same time. This would mean that service personnel would have to make a minimum number of trips to the vending machine to ensure that all selections have work objects for vending all of the time. This objective has never before even remotely been approached in the art. However, the apparatus of the present invention in the preferred embodiment having the capacities previously set forth in practice approaches this objective to a degree far in advance of that heretofore possible. Armed with a work schedule carefully programmed based upon available sales statistics, service personnel can be directed as to which selections are to be loaded into which work object storage areas. Since the storage capacities have the ready capability of being reconfigured by simply reprogramming the electronic control system, each vending machine has the capability of being fine tuned by such reconfiguration to correlate more precisely with the actual sales of each selection from each vending machine. Such reapportionment is achieved in the apparatus of the present invention by reprogramming the electronic control system of the apparatus to link the vend mechanisms 310 of different combinations of work object storage areas to achieve the desired result; that is assigning space to sales as previously discussed. As a consequence, a multiplicity of different combinations of work object storage areas can be linked so that the capacity of a particular type of work object within the vending machine can be adjusted upwardly or downwardly by the simple expedient of reprogramming the electronic control system.

Although it is not believed necessary except perhaps in rare instances, the work object storage areas can physically be reapportioned as well. This may physically be achieved by the receipt of different combinations of modules within the interior compartment 27 of the vending machine 20. This is accomplished by removal of some or all of the upper and lower modules 221 and 101 from the main frame 50 and replacement of them with a different combination of modules more precisely defining the percentages desired. The main frame 50 and subframe 100 are first removed from the interior compartment 27 of the vending machine 20. The screws are removed from the respective mounting tabs 53 of the main frame 50 and the screws are removed from the mounting tabs 69 of the central frame member 64. The main frame and associated subframe 100 can then simply slidably be removed from the interior compartment on the horizontal surfaces 49 of the brackets 48. With the entire main frame removed, all portions are conveniently accessible. The modules are then removed as desired from the points of attachment previously described by a reversal of the steps previously set forth. The new combination of modules is then simply installed in their place following the steps previously set forth. Since no permanent or semipermanent fasteners are employed, only a screw driver is required and the reconfiguration process is rapidly performed. The combination of projections, hooks and ribs previously described ensures that the modules are mounted securely, but removably, in the precise positions required. Each pair of upper and lower modules can be so designed as to define one, two, three or more work object storage areas of different storage capacities. Once so reconfigured, the main frame and subframe are reinstalled in the interior compartment as previously described.

Therefore, the apparatus for vending work objects of the present invention is capable of rapid and yet precise assembly for apportionment of the storage area within the vending machine to correspond to the desired percentages of vendable commodities within the storage area; can rapidly be reprogrammed in the field to reconfigure the storage capacities to those desired for the commodities to be vended; reduces to a minimum not heretofore achieved in the art the number of vend mechanisms required for a given vending machine; can be manufactured, operated, serviced and repaired with the facility and dependability not heretofore achieved in the art; and otherwise achieves operational benefits not heretofore possible.

Although the invention has been herein shown and described in what is conceived to be the most practical and preferred embodiment, it is recognized that departures may be made therefrom within the scope of the invention which is not to be limited to the illustrative details disclosed.

Having described our invention, what we claim as new and desire to secure by Letters Patent is:

1. An apparatus for vending work objects, the apparatus comprising:

A. a housing having an interior compartment;

B. at least one pair of main frame members mounted on the housing within the compartment and with the main frame members of said pair extending through the compartment in spaced relation;

C. a subframe, composed of a plurality of releasably interlockable modules adapted selectively to be interlocked in predetermined combinations to define work object storage areas dimensioned to receive predetermined quantities of said work objects and the subframe releasably mounted on and extending between said main frame members with the work object storage areas disposed in gravitationally feeding relation and wherein a pair of said modules are disposed in substantially side-by-side relation and the modules of said pair of modules individually define two substantially identical tracks individually extending to dispensing passages disposed in adjacent spaced relation; and D. a vend mechanism mounted on the modules of said pair of modules between said dispensing passages and having two pairs of control members with the control members of each pair of control members individually selectively operable to move between predetermined stop positions, extending into one of said dispensing passages, and release positions, retracted therefrom, whereby said vend mechanism is selectively operable individually to vend work objects from said work object storage areas by selective individual movement of the control members between their respective stop and release positions and said vend mechanism further includes:

1. a substantially rigid vend frame having a pair of opposite side walls and a pair of opposite end walls bounding a cam shaft compartment;
2. a first pair of said two pairs of control members individually mounted on and extending between the opposite side walls of the vend frame within the cam shaft compartment adjacent to one of the opposite end walls thereof and individually pivotal in opposite directions from and into said cam shaft compartment;
3. a second pair of said two pairs of control members individually mounted on and extending between the opposite side walls of the vend frame within the cam shaft compartment adjacent to the other of said opposite end walls thereof and individually pivotal in opposite directions from and into said cam shaft compartment;
4. a cam shaft mounted on and extending between the opposite end walls through the cam shaft compartment between the control members of said first pair of control members and between the control members of said second pair of control members for pivotal movement substantially about a longitudinal axis of rotation, said cam shaft mounting a first cam adjacent to and in engagement with the control members of said first pair of control members and mounting a second cam adjacent to and in engagement with the control members of said second pair of control members; and
5. a vend motor mounted on one of said opposite end walls of the vend frame in driving relation to said cam shaft operable to pivot said cam shaft about said longitudinal axis of rotation thereof selectively to move the control members of the first and second pairs of control members from and into said cam shaft compartment and thereby to and from their respective stop and release positions selectively to isolate one of said work objects in one of said work object storage areas and then to release the work object so isolated for vending from said housing.

2. The apparatus of claim 1 wherein said cam shaft has a drive end portion extending through an opposite end wall of the vend frame, clips are mounted on and extend from said opposite end wall on opposite sides of the drive end portion of the cam shaft and the vend motor is adapted to be fitted about said drive end portion in driving relation thereto and releasably retained thereon by said clips.

3. The apparatus of claim 1 including a pair of micro switches individually mounted on the opposite side walls of said pair of opposite side walls and extending in substantially opposite directions individually into the work object storage areas defined by the dispensing passages of said tracks for engagement by work objects therewithin and a control system is operably connected to said micro switches and the vend motor for pivoting said cam shaft selectively to move the control members of said first and second pairs of control members in response to selection by an operator selectively to release work objects from the work object storage areas if, upon said selection by an operator, the micro switch for the work object storage area selected detects that there is at least one work object therewithin.

4. The apparatus of claim 3 wherein said control system is operable to operate the vend motor to pivot the cam shaft selectively in either direction about said longitudinal axis of rotation; the control system is operable after each vending cycle to operate the vend motor to pivot the cam shaft to a start position thereof retaining said first pair of control members in said release positions and the second pair of control members in said stop positions; and the control system is operable in the next vending cycle to operate the vend motor to pivot the cam shaft in the direction for moving the second control member of the work object storage area selected in said next vending cycle to its release position for vending therefrom only after said micro switch thereof detects that there is at least one work object therewithin.

5. The apparatus of claim 1 wherein said vend mechanism is mounted on the subframe in an operational position, the vend mechanism is adapted to be moved to and from said operational position by the slidable engagement of slots and projections borne by the vend frame and modules defining a path for the vend mechanism extending between the dispensing passages of the tracks of the respective modules of said pair of modules whereby the vend mechanism can substantially slidably be removed from the operational position and from the apparatus for repair or replacement.

6. The apparatus of claim 1 wherein said cam shaft has a grasping end portion extending through an opposite end wall of said pair of opposite end walls opposite that mounting said vend motor for grasping for manually pivoting the cam shaft about the longitudinal axis of rotation for adjustment, service, repair or replacement.

7. The apparatus of claim 1 including a stop adapted releasably to be mounted on one of the modules of said pair of modules extending into the work object storage area thereof for engagement by one of said work objects to retain that work object and the work objects thereabove in position against gravitational release from the work object storage area during adjustment, service, or repair of the apparatus.

8. An apparatus for vending work objects, the apparatus comprising a frame defining at least two work object storage areas dimensioned individually to receive a plurality of said work objects for sequential gravitational delivery through individual dispensing passages; and a single vend mechanism mounted in an operational position between said dispensing passages and having a substantially rigid vend frame having an end wall, a cam shaft mounted on the vend frame for rotation about a longitudinal axis, two pairs of control members mounted on the vend frame for engagement by the cam shaft, and a vend motor mounted on said end wall of the vend frame in driving relation to said cam shaft and selectively operable to pivot the cam shaft about said longitudinal axis selectively to move the control members between predetermined stop positions, individually extending into said dispensing passages, and release positions, retracted from the dispensing passages, whereby said vend mechanism is operable selectively to vend work objects from either of said work object storage areas through their respective dispensing passages upon selective movement of the control members between said stop positions and said release positions.

9. The apparatus of claim 8 wherein said cam shaft of the vend mechanism has an end portion extending to a position accessible for manual pivoting of the cam shaft for the selective manual operation of the vend mechanism for service and repair.

10. The apparatus of claim 8 wherein the vend mechanism and the frame are adapted releasably to be interlocked to mount the vend mechanism in said operational position permitting release thereof for removal of the vend mechanism from the operational position for service, repair or replacement.

11. The apparatus of claim 8 wherein the vend motor and the vend frame are adapted releasably to be interlocked with each other and the vend frame and the frame of the apparatus are adapted releasably to be interlocked with the vend motor in a drive position whereby the vend mechanism can be released from said operational position and removed from the apparatus and the vend motor can be released from said drive position for service, repair or replacement without having to disassemble the vend frame.

12. The apparatus of claim 8 wherein a stop clip is formed as part of said frame and adapted to be broken from said frame and then releasably mounted on the frame extending into the work object storage area thereof for engagement by one of said work objects to retain that work object and the work objects thereabove in position against gravitational release from the work object storage area during adjustment, service, or repair of the apparatus.

* * * * *

UNITED STATES PATENT AND TRADEMARK OFFICE

CERTIFICATE OF CORRECTION

PATENT NO. : 5,368,190

DATED : November 29, 1994

INVENTOR(S) : LARRY E. HIEB; TOSHIYUKI TAKAMURA

It is certified that error appears in the above-identified patent and that said Letters Patent is hereby corrected as shown below:

Column 2, line 3, delete "acid" and substitute ---add---.

line 6, delete "acid" and substitute ---add---.

line 52, delete "frown" and substitute ---from---.

Column 6, line 16, delete "tapper" and substitute ---upper---.

Column 15, line 45, delete "he" and substitute ---the---.

Column 16, line 48, delete "he" and substitute ---the---.

line 61, delete "frown" and substitute ---from---.

UNITED STATES PATENT AND TRADEMARK OFFICE

CERTIFICATE OF CORRECTION

PATENT NO. : 5,368,190

DATED : November 29, 1994

INVENTOR(S) : Larry E. Hieb, et al

It is certified that error appears in the above-indentified patent and that said Letters Patent is hereby corrected as shown below:

Column 18, line 2, delete "rended" and substitute --vended--

Signed and Sealed this

Twenty-first Day of February, 1995

*Attest:*

Bruce Lehman

BRUCE LEHMAN

*Attesting Officer*

*Commissioner of Patents and Trademarks*

--